US009429132B1

(12) United States Patent
Lepley et al.

(10) Patent No.: US 9,429,132 B1
(45) Date of Patent: Aug. 30, 2016

(54) CAPACITIVE IGNITION SYSTEM WITH ION-SENSING AND SUPPRESSION OF AC RINGING

(71) Applicant: Hoerbiger Kompressortechnik Holding GmbH, Vienna (AT)

(72) Inventors: Joseph M Lepley, Girard, OH (US); David Lepley, Girard, OH (US); Steven B Pirko, Lake Milton, OH (US); Arno Gschirr, Igls (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 0 days.

(21) Appl. No.: 15/079,698

(22) Filed: Mar. 24, 2016

(51) Int. Cl.

| | |
|---|---|
| ***F02P 3/01*** | (2006.01) |
| ***F02P 3/09*** | (2006.01) |
| ***F02P 3/08*** | (2006.01) |
| ***F02P 3/12*** | (2006.01) |
| *F02P 3/04* | (2006.01) |

(52) U.S. Cl.
CPC ..... *F02P 3/09* (2013.01); *F02P 3/0884* (2013.01); *F02P 3/12* (2013.01); *F02P 3/0435* (2013.01)

(58) Field of Classification Search
CPC ..... H05B 41/00; F02P 3/01; F02P 15/10; F02P 15/12; F02P 1/086; F02P 9/002; F02P 17/12; F02P 3/12
USPC .... 315/209 CD, 209 M, 209 T, 209 SC, 276, 315/277, 279
See application file for complete search history.

(56) References Cited

U.S. PATENT DOCUMENTS

| | | | | |
|---|---|---|---|---|
| 5,230,240 | A | 7/1993 | Ohsawa et al. | |
| 5,777,216 | A | 7/1998 | Van Duyne et al. | |
| 7,778,002 | B2 | 8/2010 | Skinner et al. | |
| 8,978,632 | B2 | 3/2015 | Steinrueck et al. | |
| 2004/0084035 | A1* | 5/2004 | Newton | F02M 26/01 123/630 |

* cited by examiner

*Primary Examiner* — Tuyet Vo
(74) *Attorney, Agent, or Firm* — Dykema Gossett PLLC

(57) ABSTRACT

In order to reduce AC ringing of the secondary voltage after the spark event in a capacitive ignition system, which would influence ion-sensing, a secondary winding current ($I_R$) flowing through the secondary winding (4) after the spark event is forced to flow through a forward-biased muting diode (D1) that is connected across the secondary winding (4).

4 Claims, 4 Drawing Sheets

CAPACITIVE IGNITION SYSTEM WITH ION-SENSING AND SUPPRESSION OF AC RINGING

BACKGROUND OF THE INVENTION

The present invention pertains to a capacitive ignition system with ion-sensing comprising an ignition coil, with a primary winding that is connected to an energy source for providing the energy for a spark event and with a secondary winding having a first terminal connected to a spark plug so that a secondary voltage across the secondary winding is applied to the spark gap of the spark plug, an ionization current biasing and measurement circuitry on a secondary side of the ignition coil for providing a biasing voltage to the spark gap after the spark event for ion-sensing and a diode that is connected across the secondary winding. The invention pertains also to a method for damping AC ringing after occurrence of a spark event in a capacitive ignition system with ion-sensing.

It is well known that the combustion process of an internal combustion engine can be analysed using the ionization current across the spark gap of a spark plug. When the spark plug sparks the gas surrounding the spark gap is ionized. If a voltage is applied across the spark gap after the spark event has occurred, the ionized gas causes ionization current to flow across the spark gap that can be measured and analysed using suitable detection circuits. Measuring and analysing the ionization current (the so called ion-sensing) allows detecting misfire, engine knock, peak pressure, a deteriorating spark plug (plug fouling) and other characteristics of the engine or the combustion process. Information from ion-sensing enables also the correction or adjustment of ignition parameters in order to adapt to different load conditions or to improve the performance of the engine or to decrease emissions or fuel consumption, by influencing the air/fuel-ratio, for example. There are many known methods and systems in the prior art for detecting, measuring and analysing an ionization current.

An ignition system usually uses an ignition coil having a primary and secondary winding. The energy required for sparking is supplied from the primary winding to the secondary winding causing a secondary voltage across the secondary winding that is applied to the spark gap. Dependent on the energy source on the primary side for generating the primary voltage across the primary winding, it is differed between inductive ignition systems and capacitive ignition systems.

In an inductive ignition system the energy is stored in the primary winding which is released for sparking. To this end a primary switch in series with the primary winding is turned on for loading the coil primary that is connected to a supply voltage. The spark occurs when the primary switch is turned off. Inductive ignition, also with ion-sensing, is well known, e.g., from U.S. Pat. No. 5,230,240 A. In U.S. Pat. No. 5,230,240 A, a diode across the secondary winding is shown which prevents unwanted sparking when the primary switch turns on to load the coil primary. This diode is forward biased when the switch is turned on, and reverse biased when the switch is turned off. Hence, the diode conducts before the desired spark breakdown across the spark plug electrodes occurs. The diode across the secondary winding would need to conduct significant current every time the primary switch is turned on and would then need to dissipate the power again. This would significantly burden the diode, and a diode with high power rating would be required.

In a capacitive ignition system a storage capacitor on the primary side of the ignition coil stores the energy for sparking. The storage capacitor is discharged over the primary winding to generate the primary voltage across the primary winding, e.g., by turning on a switch that connects the capacitor with the primary winding. After the spark event, the capacitor is recharged for the next spark event. With capacitive ignition it is possible to generate short duration, high power sparks and, hence, is particularly suitable for igniting lean mixtures, such as in gas engines.

Capacitive ignition, also with ion-sensing, is well known, e.g., from WO 2013/045288 A1. In WO 2013/045288 A1 a resistor is connected in series with the spark plug for measuring the ionization current. The required bias voltage across the spark plug electrodes for ion-sensing is generated by repeatedly discharging the storage capacitor on the primary side after the initial spark breakdown.

A major challenge in combustion monitoring via ion-sensing of the spark gap is minimization of the associated ringing of the secondary voltage in the secondary winding of the ignition coil after the spark event. The coil secondary winding is an inductor with a DC current (direct current) flowing through it whenever the spark is created. When the spark goes out the secondary DC current drops to zero momentarily and as a result the charged inductance of the coil secondary winding tries to maintain the previous current flow. But because the secondary path is now highly resistant to the flow of DC current at the available secondary voltage, the only current which can flow is an AC current (alternating current) through the parasitic capacitance of the spark plug gap. This AC current causes the ringing of the secondary voltage. This parasitic AC current is often much larger in magnitude than the DC ion current which is the signal of interest with ion-sensing, which makes ion-sensing difficult. This phenomenon has traditionally been managed by a number of different approaches, namely reduced coil impedance and active "turn-off" circuits on the primary side of the circuit. Reduced coil impedance can significantly impact ignition performance as the coil with reduced coil impedance typically delivers very short duration sparks with limited output energy. Active "turn-off" circuits on the primary side, on the other hand, can improve the ringing behaviour on the secondary winding, but are cumber-some to implement effectively and have limited benefit.

From EP 1 990 813 A1 an inductive ignition system with ion-sensing and an apparatus for reducing ringing of the secondary voltage is known. For ion-sensing a capacitor on the secondary side of the ignition coil is charged during the flow of a spark current. After the spark breakdown occurred, the capacitor is discharged to generate the bias voltage across the spark plug electrodes for detecting the ionization current that is measured. For reducing the ringing of the secondary voltage, that would influence the measurement of the ionization current, an additional control winding in series with a diode are arranged on the primary side of the ignition coil. This diode is oriented so that it is forward biased only when a current opposite to the spark current, e.g., an ionization current, flows and, hence, does not conduct during the spark event. After the spark goes out, the control winding and the diode cooperate to dissipate residual electrical charge in the coil in order to limit the ringing. However, the diode introduces an incremental parasitic loss during charging of the ignition coil primary that will detrimental-ly increase the amount energy required for charging the coil primary.

Another capacitive ignition system with ion-sensing is shown in EP 879 355 B1, which uses an additional energy source on the secondary side for generating a high current spark arc and also for generating the required bias voltage across the spark plug electrodes for ion-sensing. The energy source of the primary side is used solely for creating a spark across the spark gap. To this end a high-voltage diode is connected across the secondary winding. If the capacitor on the primary side is discharged for sparking, a high voltage is created on the secondary winding. This high voltage is also applied across the spark gap and ionizes the matter surrounding the spark gap and creates the spark. Once the spark gap is ionized, the secondary side energy source connected to the coil secondary provides the required current, which flows over the ionized spark gap, to generate the arc for the spark event. This spark current flows also over the forward-biased high-voltage diode, which ensures that the secondary side energy source is decoupled from the primary side of the ignition coil. The high-voltage diode is used to supply the power to the spark. The energy for creating the spark which is supplied by the secondary side energy source connected to the coil secondary is quickly dissipated in the secondary winding and the high-voltage diode. In addition, after the spark event, the secondary side energy source provides also the ionization current for ion sensing. This ionization current flows again over the forward-biased high-voltage diode and, during ion-sensing, the high-voltage secondary side is again decoupled from the primary side of the ignition coil to pre-vent undesired cross conduction or interaction of the two separate isolated energy sources. The additional energy source increases the complexity of the ignition system with regard to hardware, as well as with regard to timing and control of the energy sources. The secondary winding and the high-voltage diode are significantly thermally burdened. Therefore, both the ignition coil and the high-voltage diode must be designed or chosen to withstand this high thermal load caused by the fact that the secondary side high-voltage diode conducts both the spark current and the ionization current. In EP 879 355 B1 a low pass filter is used to condition the ionization current signal. Because of the polarity of the secondary side energy source, the secondary ringing voltages are not suppressed by the high-voltage diode which can be seen in the waveforms of FIGS. 5*a* and 5*b* of EP 879 355 B1.

It is an object of the present invention to provide a method and an apparatus for easily reducing AC ringing of the secondary voltage after the spark event in a capacitive ignition system.

SUMMARY OF THE INVENTION

This objective is achieved in that the diode is connected across the secondary winding so that it is reverse-biased for a spark current flowing through the spark gap during the spark event of the spark plug and forward-biased for an AC ringing voltage after the spark event. The forward-biased muting diode connected across the secondary winding forces a secondary current to flow through the secondary winding after the spark event. A secondary current flowing through the secondary winding caused by the secondary ringing voltage when the spark ends is forced to flow through a forward-biased muting diode that is connected across the secondary winding because the muting diode shortens the secondary winding after the spark event. By the muting diode electrical energy that re-mains stored in the secondary winding of the ignition coil is rapidly dissipated in the resistance of the secondary winding because the current flowing in the secondary winding is forced to flow through the low-impedance path provided by the forward-biased muting diode. In this way the secondary current is held away from the spark gap and thus, does not influence ion-sensing after the spark event. Therefore, the secondary AC current is prevented from flowing through the spark gap after the spark event and thereby does not influence the small DC ionization current that flows through the spark gap for ion-sensing.

In an advantageous, easy to implement embodiment, the ionization current biasing and measurement circuitry is connected to a second terminal of the secondary winding and comprises a biasing capacitor that is connected to the second terminal and that is charged during the spark event by the spark current and that is discharged after the spark event for providing the biasing voltage.

It is especially advantageous to use a muting diode with an avalanche breakdown voltage in the range of a maximum voltage rating of the ignition coil. When the muting diode with such an avalanche breakdown voltage is exposed to spark voltages above the avalanche breakdown voltage, the spark voltage is limited due to the occurring avalanche breakdown of the muting diode and the ignition coil is protected from damage due to high voltages.

The present invention is explained in greater detail below with reference to FIGS. 1 to 4, which schematically show advantageous embodiments of the invention by way of example and in a non-limiting manner.

DETAILED DESCRIPTION OF THE DRAWINGS

Figure 1:
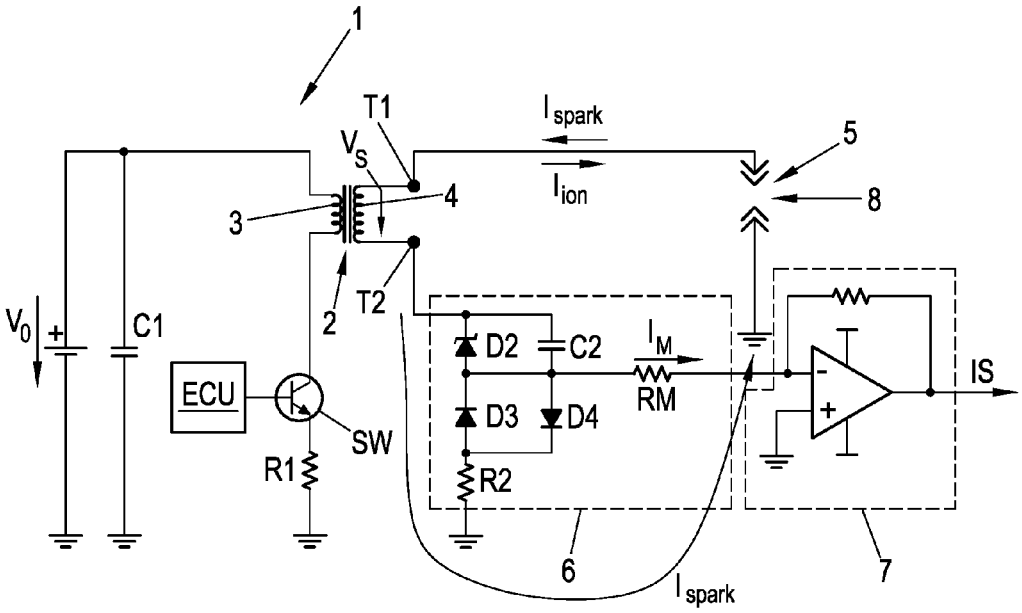
Fig. 1 (Prior Art)
FIG. 1 shows a capacitive ignition system according to the prior art.

A capacitive ignition system 1 as known from prior art and as shown in FIG. 1 comprises an ignition coil 2 with a primary winding 3 and a secondary winding 4. A storage capacitor C1 is provided on the primary side of the ignition coil 2 that stores the required energy for the spark event. The storage capacitor C1 is charged by a supply voltage $V_0$. A switch SW, a semiconductor switch like a transistor, for example, is connected in series to the primary winding 3. The storage capacitor C1 is advantageously (but not necessarily) connected in parallel to the primary winding 3, as in FIG. 1. A first terminal T1 of the secondary winding 4 is connected in known manner with the grounded spark plug 5, so that a secondary voltage $V_S$ across the secondary winding 4 is applied to the spark gap 8.

If the switch SW is turned on, e.g., under control of a control unit ECU, the storage capacitor C1 discharges via the primary winding 3, and an optionally possible resistor R1, causing a secondary voltage $V_S$ across the secondary winding 4. This secondary voltage $V_S$ is applied to the spark gap 8 of the spark plug 5. When the secondary voltage $V_S$ is sufficiently high, a spark breakdown across the spark gap 8 occurs and a spark current $I_{spark}$ flows into the spark gap 8 for maintaining the arc across the spark gap 8 (see also FIG. 3A). The electrical energy for the spark event, i.e., for creating a spark and for maintaining the arc, is provided by the energy source on the primary side of the ignition coil 2.

During the spark event, the first terminal T1 of the ignition coil 2 connected to the spark plug 5 goes negative and the voltage across the spark gap 8 is essentially constant and the amplitude of spark current $I_{spark}$ gradually declines. At some time after the spark event, i.e., after the spark has extinguished, the ionization current $I_{ion}$ can be measured, as described in the following.

The capacitive ignition system 1 further comprises an ionization current biasing and measurement circuitry 6 that measures a ionization current $I_{ion}$ across the spark gap 8 and provides a measurement signal $I_M$ proportional to the ionization current $I_{ion}$. The ionization current biasing and measurement circuitry 6 can be implemented in many different ways, for example as shown in FIG. 1. The ionization current $I_{ion}$ can be measured in many different ways known to those skilled in the art. The ionization current biasing and measurement circuitry 6 is connected to a second terminal T2 of the secondary winding 4, which is usually connected to ground. The measurement signal $I_M$ can be further processed in a signal conditioning unit 7, e.g., by filtering or by amplifying with current amplifier as in FIG. 1, and is output as ion signal IS.

The ionization current biasing and measurement circuitry 6 comprises for example a biasing capacitor C2 connected in parallel to a diode D2 that are connected to the second terminal T2 of the secondary winding 4. Biasing capacitor C2 and diode D2 are also connected to opposing oriented, parallel connected diodes D3, D4 that in turn are connected to ground via resistor R2. A measurement resistor RM is serially connected to the connection between the parallel connected biasing capacitor C2 and diode D2 and the parallel connected diodes D3, D4. The current flowing over the measurement resistor RM is the measurement signal $I_M$. It would of course also be possible to measure the ion current in many other ways.

When a spark current $I_{spark}$ flows as result of a spark breakdown across the spark gap 8, the spark current $I_{spark}$ charges also the biasing capacitor C2 via the resulting current path (secondary winding 4-biasing capacitor C2-diode D4-(optional) resistor R2-ground-spark gap 8). After the spark went out, the biasing capacitor C2 discharges and provides the DC biasing voltage $V_{DC}$ to the spark gap 8 required for ion-sensing. This DC biasing voltage $V_{DC}$ causes the ionization current $I_{ion}$ that flows in opposite direction of the spark current $I_{spark}$.

Figure 3A:
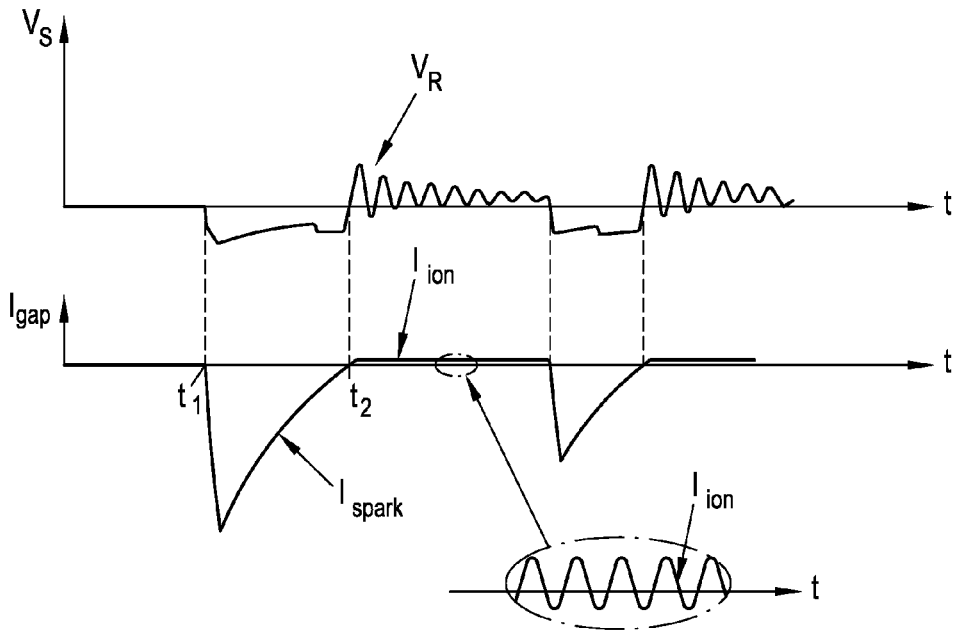
FIG. 3A shows the secondary voltage and the current through the spark gap without the inventive muting diode.

In FIG. 3A the resulting secondary voltage $V_S$ signal and the signal of the current $I_{gap}$ flowing over the spark gap 8, i.e., the spark current $I_{spark}$ and the ionization current $I_{ion}$, are shown. FIG. 3A depicts two subsequent spark events. At time $t_1$ the switch SW is turned on causing a high secondary voltage $V_S$. As soon as the breakdown voltage is reached a spark breakdown across the spark gap 8 occurs and the spark current $I_{spark}$ flows. The spark current $I_{spark}$ decreases as the storage capacitor C1 discharges. After the spark went out at time t2, because the ignition coil 2 can no longer maintain the flow of spark current $I_{spark}$ over the spark gap 8 due to the limited energy available at the primary side, the biasing capacitor C2 provides a DC bias voltage to the spark gap 8 causing the ionization current $I_{ion}$ to flow. The typical open circuit AC ringing voltage $V_R$ of the ignition coil 2 after the spark went out is superimposed to the DC bias voltage of biasing capacitor C2. The resulting ionization current $I_{ion}$ (that is much lower in magnitude than the spark current $I_{spark}$) flowing through the spark gap 8 consists of a small DC ionization current $I_{ion}$ which creates a small DC ionization voltage of interest combined with the much larger amplitude AC ringing current caused by the coil secondary AC ringing voltage $V_R$ (as indicated in FIG. 3A). This makes the measurement of the small DC ionization current difficult.

Figure 2:
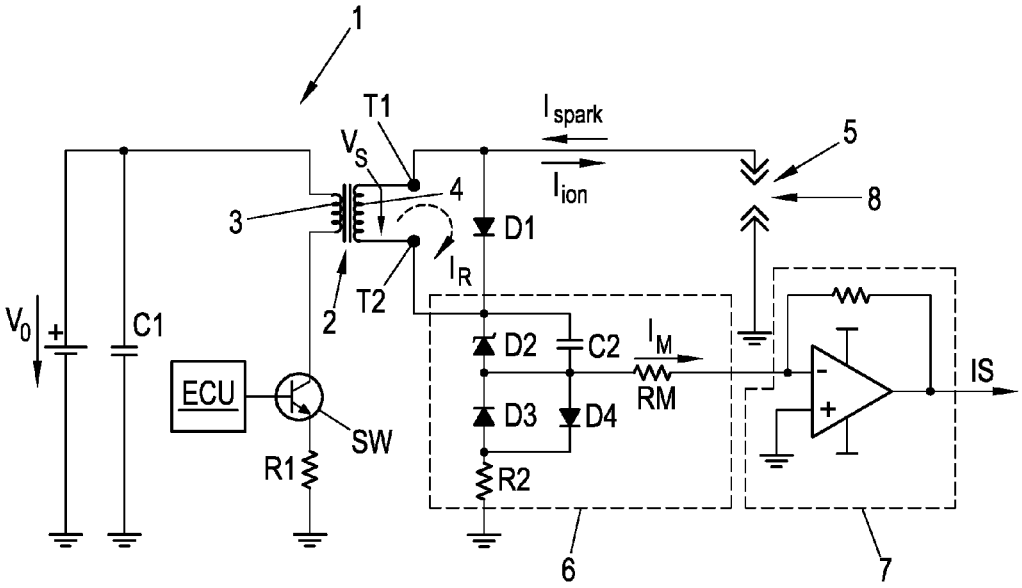
FIG. 2 shows a capacitive ignition system with a muting diode in accordance with the invention.

To avoid that the open circuit AC ringing voltage $V_R$ influences the ionization current $I_{ion}$ after the spark event a high-voltage muting diode D1, e.g., a 40 kV muting diode, is connected across the secondary winding 4, i.e., in parallel to the secondary winding 4 or in other words between the first terminal T1 and the second terminal T2 of the secondary winding 4, of the ignition coil 2 in accordance to the invention, as shown in FIG. 2. This muting diode D1 is connected in such way that it is reversed-biased for the flowing spark current $I_{spark}$, forcing the spark current $I_{spark}$ to flow over the spark gap 8 and the secondary winding 4. To this end, the cathode of the muting diode D1 is connected to the second terminal T2 of the secondary winding 4 of the ignition coil 2, to which also the ionization current biasing and measurement circuitry 6 is connected to in the shown embodiment.

Figure 3B:
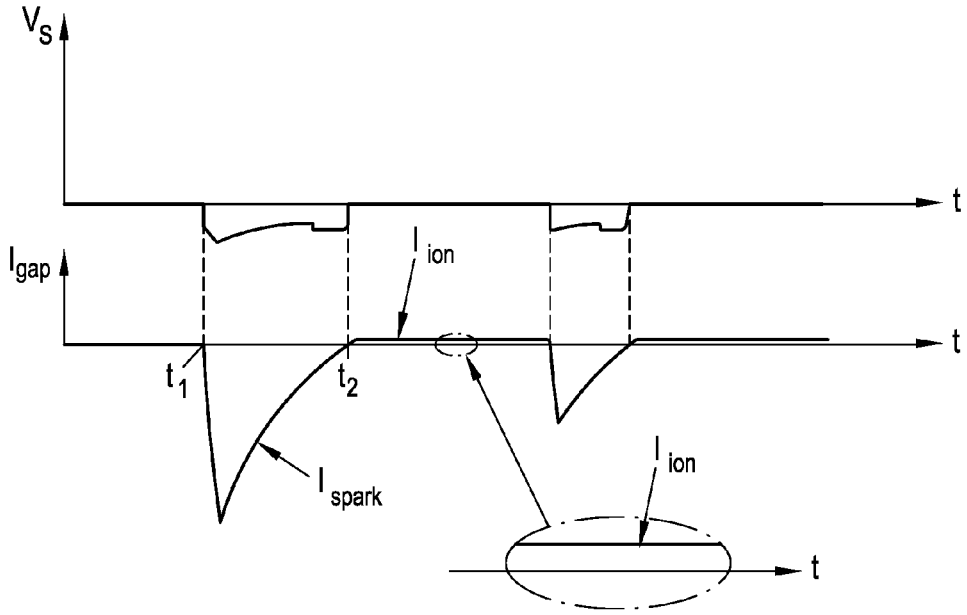
FIG. 3B shows the secondary voltage and the current through the spark gap with the inventive muting diode.

After the spark event, both before and during the time when the ionization current $I_{ion}$ flows, the muting diode D1 has the effect that the open circuit AC ringing voltage $V_R$ at the secondary winding 4 is at the first opposite polarity ring (voltage swing) clamped to a simple forward-biased diode drop. Thereby, the local secondary winding current $I_R$ is held away from the ionization current biasing and measurement circuitry 6 as the secondary winding current $I_R$ (indicated in FIG. 2) is forced to flow through the secondary winding 4 by the forward-biased muting diode D1 which provides a very low impedance path for this current $I_R$. Given this low impedance path directly across the secondary winding 4 of the ignition coil 2, this secondary winding current $I_R$ does not flow thru the capacitance of the spark gap 8, since the voltage potential exists only between the two terminals T1, T2 of the secondary winding 4 and is shorted by the muting diode D1. As a consequence, the inductive coil energy remaining after the spark event is rapidly consumed in the form of $I^2R$ losses inside the coil secondary winding 4, with the current I flowing through the secondary winding 4 and the resistance R of the secondary winding 4. Thus, the unwanted AC ringing secondary winding current $I_R$ is held away from the spark gap 8 and does not influence the measurement of the ionization current $I_{ion}$ in the ionization current biasing and measurement circuitry 6. The muting diode D1 does not affect the normal operation of the capacitive ignition system 1, but only suppresses the undesired coil ringing after the spark event. The effect of the muting diode D1 is depicted in FIG. 3B. It can clearly be seen that the AC ringing after the spark event has been eliminated.

Figure 4:
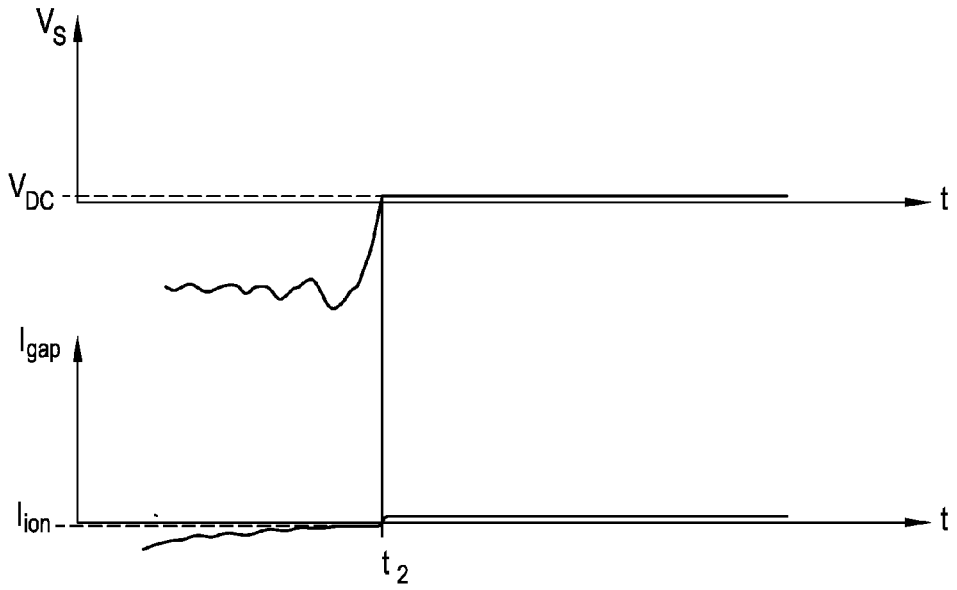
FIG. 4 shows a zoomed in view of the tail-end part of the spark event.
Figure 3A:
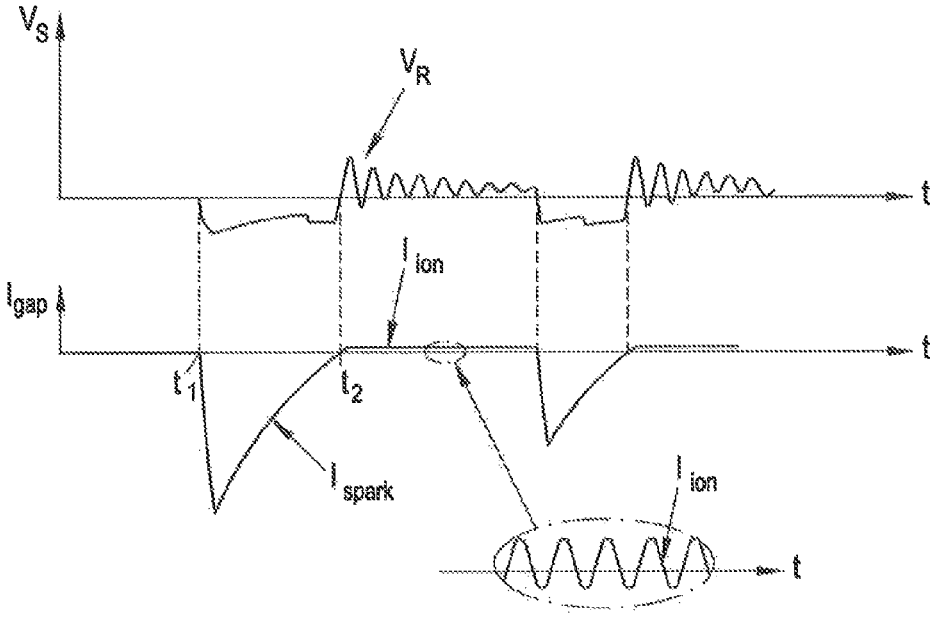
Figure 3B:
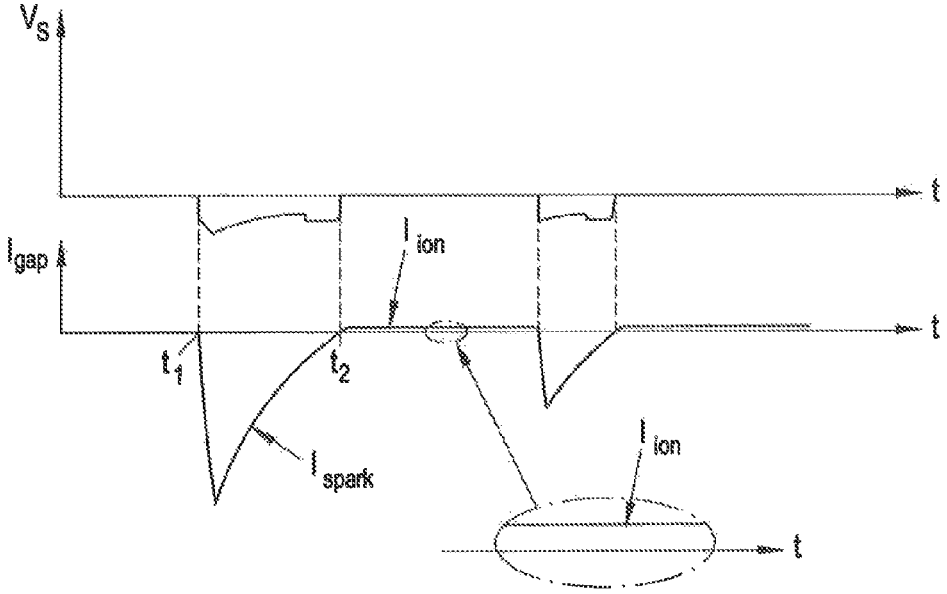

FIG. 4 shows a zoomed in view of the tail-end part of the spark event. The AC ringing voltage $V_R$ has been eliminated and the small DC biasing voltage $V_{DC}$ caused by the discharging biasing capacitor C2 is applied to the spark gap 8 which in turn causes the small (as compared to the spark current $I_{spark}$) ionization current $I_{ion}$.

An additional benefit of the muting diode D1 is that the muting diode D1 can be selected in such a way that avalanche breakdown occurs when the muting diode D1 is exposed to spark voltages above the maximum voltage rating of the ignition coil 2, thereby limiting the spark voltage and protecting the ignition coil 2. To this end the avalanche breakdown voltage of the muting diode D1 should be in the range of the maximum voltage rating of the ignition coil 2, preferably in the range of 90% to 110% of the maximum voltage rating of the ignition coil 2. The avalanche breakdown voltage does preferably not exceed the maximum voltage rating of the ignition coil 2.

The invention claimed is:

1. A capacitive ignition system (1) with ion-sensing comprising an ignition coil (2), with a primary winding (3) that is connected to an energy source for providing the energy for a spark event and with a secondary winding (4) having a first terminal (T1) connected to a spark plug (5) so that a secondary voltage ($V_S$) across the secondary winding (4) is applied to the spark gap (8) of the spark plug (5), an ionization current biasing and measurement circuitry (6) on a secondary side of the ignition coil (2) for providing a biasing voltage to the spark gap (8) after the spark event for ion-sensing and a diode (D1) that is connected across the secondary winding (4), wherein the diode (D1) is connected across the secondary winding (4) so that it is reverse-biased for a spark current flowing through the spark gap (8) during the spark event of the spark plug (5) and forward-biased for an AC ringing voltage ($V_R$) after the spark event.

2. A capacitive ignition system (1) according to claim 1, wherein the ionization current biasing and measurement circuitry (6) is connected to a second terminal (T2) of the secondary winding (4) and comprises a biasing capacitor (C2) that is connected to the second terminal (T2) and that is charged during the spark event by the spark current ($I_{spark}$) and that is discharged after the spark event for providing the biasing voltage.

3. A capacitive ignition system (1) according to claim 1, wherein a muting diode (D1) with an avalanche breakdown voltage in the range of a maximum voltage rating of the ignition coil (2), preferably equal to the maximum voltage rating of the ignition coil (2), is used.

4. A method for damping AC ringing after occurrence of a spark event in a capacitive ignition system (1) with ion-sensing comprising a primary winding (3) that is connected to an energy source that provides the energy for a spark event and a secondary winding (4) having a first terminal (T1) connected to a spark plug (5) so that a secondary voltage ($V_S$) across the secondary winding (4) is applied to a spark gap (8) of the spark plug (5), whereas a spark current ($I_{spark}$) flows over the spark gap (8) during the spark event, wherein after the spark event a secondary winding current ($I_R$) through the secondary winding (4) is forced to flow through a forward-biased muting diode (D1) that is connected across the secondary winding (4).

* * * * *